United States Patent [19]

Yamada

[11] Patent Number: 5,074,797

[45] Date of Patent: Dec. 24, 1991

[54] ELECTRICAL CONNECTOR FOR CONNECTING HEAT SEAL FILM TO A PRINTED WIRING BOARD

[75] Inventor: Yoshio Yamada, Kanagawa, Japan

[73] Assignee: Thomas & Betts Corporation, Bridgewater, N.J.

[21] Appl. No.: 551,974

[22] Filed: Jul. 12, 1990

[30] Foreign Application Priority Data

Jul. 21, 1989 [JP] Japan ..... 1-86451

[51] Int. Cl.[5] ..... H01R 9/09

[52] U.S. Cl. ..... 439/62; 439/67; 439/260; 439/261; 439/329

[58] Field of Search ..... 439/259, 260, 261, 263, 439/59, 62, 64, 67, 74, 329, 729, 350, 351, 327, 77, 493

[56] References Cited

U.S. PATENT DOCUMENTS

| | | | |
|---|---|---|---|
| 2,994,850 | 11/1957 | Jaeschke | 339/273 |
| 3,336,564 | 8/1967 | McCaughey | 339/99 |
| 3,475,717 | 3/1967 | Lane | 339/75 |
| 3,526,869 | 1/1969 | Conrad et al. | 339/75 |
| 3,587,031 | 10/1969 | Flavin et al. | 339/95 |
| 3,731,252 | 5/1973 | McKeown et al. | 339/17 |
| 3,899,234 | 8/1975 | Yeager et al. | 339/74 |
| 4,076,362 | 2/1978 | Ichimura | 339/75 |
| 4,152,037 | 5/1979 | Bonhomme | 339/75 |
| 4,172,626 | 10/1979 | Olsson | 439/329 |
| 4,179,178 | 12/1979 | Bachman et al. | 339/111 |
| 4,397,514 | 8/1983 | Durand et al. | 339/95 |
| 4,540,228 | 9/1985 | Steele | 339/74 |
| 4,598,966 | 7/1986 | Boland | 339/75 |
| 4,629,270 | 12/1986 | Andrews, Jr. et al. | 339/75 |
| 4,636,019 | 1/1987 | Gillett et al. | 439/260 X |
| 4,640,562 | 2/1987 | Shoemaker | 439/59 X |
| 4,684,181 | 8/1987 | Massit et al. | 439/59 |
| 4,684,194 | 8/1987 | Jenkins et al. | 439/260 |
| 4,738,625 | 4/1988 | Burton et al. | 439/59 |
| 4,747,790 | 5/1988 | Masuda et al. | 439/631 |
| 4,795,897 | 1/1989 | Chalendard | 439/260 X |
| 4,850,891 | 7/1989 | Walkup et al. | 439/327 X |
| 4,881,901 | 11/1989 | Mendenhall et al. | 439/260 X |
| 4,886,461 | 12/1989 | Smith | 439/260 X |
| 4,936,790 | 6/1990 | De La Cruz | 439/260 |

FOREIGN PATENT DOCUMENTS

| | | |
|---|---|---|
| 77211762 | 3/1990 | Taiwan . |
| 2162380 | 1/1986 | United Kingdom . |

*Primary Examiner*—Larry I. Schwartz
*Assistant Examiner*—Julie R. Daulton
*Attorney, Agent, or Firm*—Robert M. Rodrick; Salvatore J. Abbruzzese

[57] ABSTRACT

An electrical connector comprises a housing having a first groove for receiving a heat seal film therein and a second groove for receiving therein a printed wiring board. A spring contact is supported by the housing for electrically connecting an electrode on the film received in the first groove and an electrode on the substrate received in the second groove. The first groove is preferably formed to have a wider opening at its entrance to permit the heat seal film to be wedged into engagement with the spring contact in the first groove. An actuator is slidably supported in the housing for bringing the spring contact into contact with the electrode on the substrate and for holding the substrate in the housing.

14 Claims, 5 Drawing Sheets

ELECTRICAL CONNECTOR FOR CONNECTING HEAT SEAL FILM TO A PRINTED WIRING BOARD

FIELD OF THE INVENTION

This device relates to a connector for achieving electrical connection between a heat seal film and a substrate such as a printed wiring board.

BACKGROUND OF THE INVENTION

To connect a heat seal film or the like and a printed wiring board or the like together, it has heretofore been popular to mount and dismount them directly to a connector actually mounted on the printed wiring board, or through a base plate.

In such cases, however, there have been problems involving time and labor to actually mount (solder) the connector on the board. Since the heat seal film, which is readily deformable, is mounted or dismounted after the connector is actually mounted on the base plate, the heat seal film may often be damaged.

SUMMARY OF THE INVENTION

The present device has as its object the provision of a connector which does not have such disadvantages peculiar to the prior art.

The connector according to the present device comprises a housing having a first groove for receiving therein a flexible film and a second groove for receiving therein a substrate. A spring contact is supported on the housing for electrically connecting an electrically conductive electrode of the film received in said first groove and an electrically conductive electrode on the substrate received in said second groove. An actuator is slidably supported in the housing for bringing the spring contact into contact with the electrode on the substrate and for holding the substrate in the housing. The heat seal film is thus easily and reliably connected to the printed substrate.

The construction of the connector according to the present device will hereinafter be described with respect to an embodiment thereof shown in the drawings.

DETAILED DESCRIPTION OF THE PREFERRED EMBODIMENT

Figure 1:
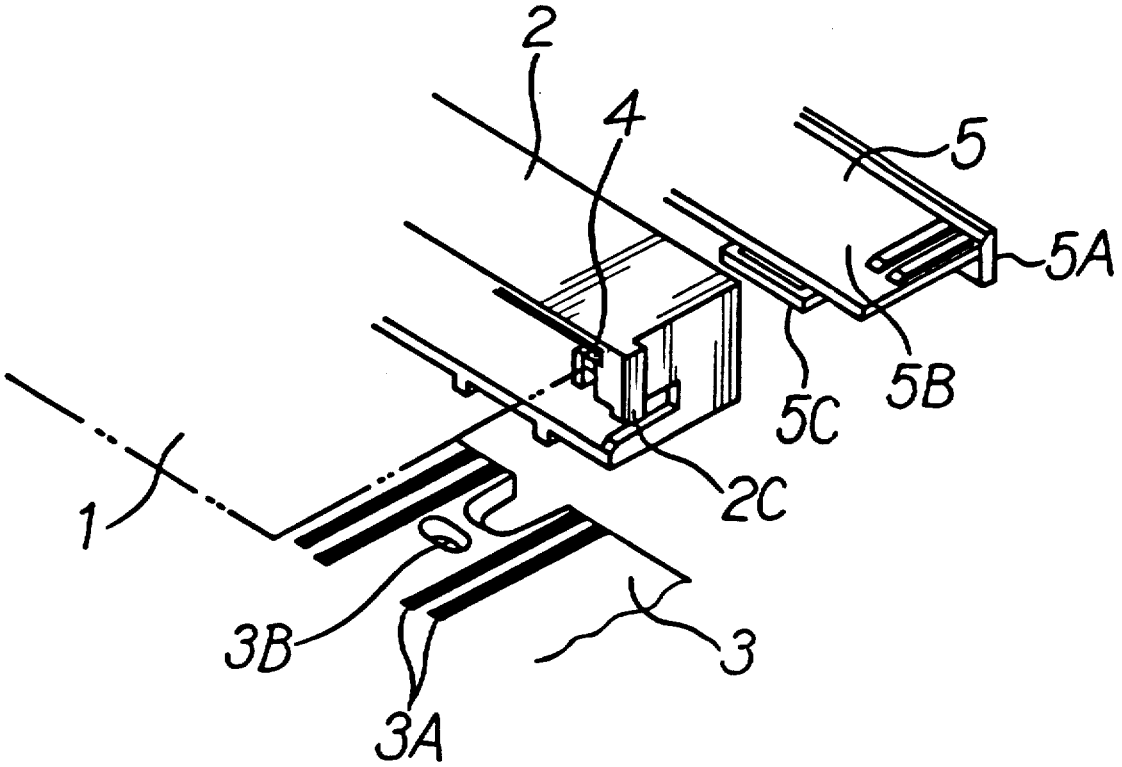
FIG. 1 is an exploded perspective view showing an embodiment of the present device.
Figure 2:
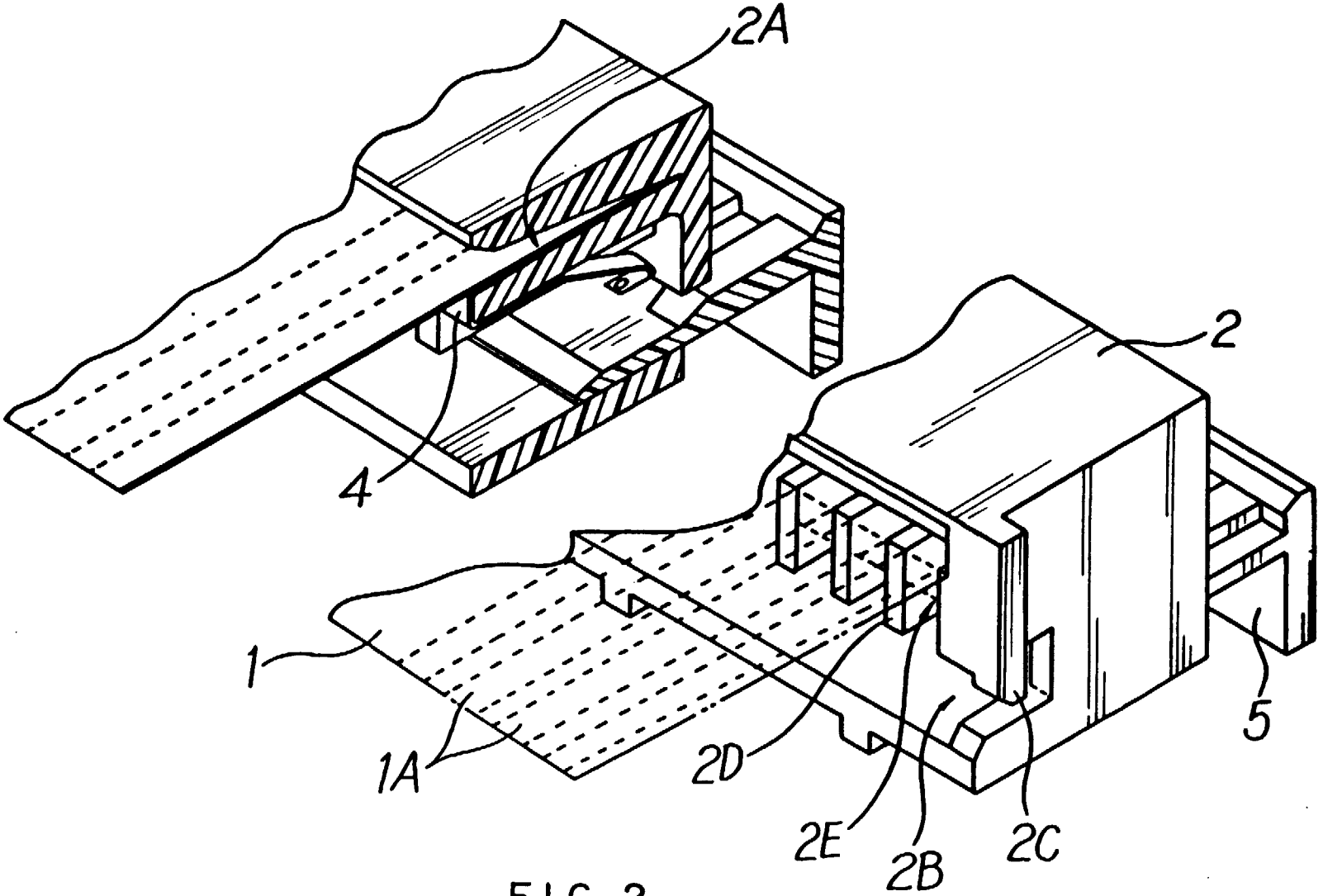
FIG. 2 is a partly broken away perspective view showing the embodiment of FIG. 1 in use.

Referring to FIG. 1, the reference numeral 1 designates a heat seal film provided with electrodes 1A (conductors) formed by causing a plurality of traces of electrically conductive material such as carbon to adhere to or be deposited by evaporation on a layer of flexible insulation. The reference numeral 2 denotes a housing having a first groove 2A as depicted in FIG. 2. In the illustrated embodiment, the housing has an opening portion which is wide open for receiving the heat seal film therein, the housing has a second groove 2B for receiving a substrate, such as a printed wiring board 3 therein.

The first and second grooves communicate with each other in the housing 2. The reference numeral 2C designates a latch projection provided on a side portion of the housing 2. The latch projection 2C fits into a latch hole 3B (FIG. 1) in the printed wiring board 3 when the printed wiring board is contained in the housing. The reference numeral 4 denotes a spring contact for electrically connecting an electrode (such as a lead or a conductor) 1A of the heat seal received in the first groove 2A and an electrically conductive electrode such as a lead or a conductor) 3A of the printed wiring board or the like received in the second groove 2B. The reference numeral 5 designates an actuator (cam) slidably supported in the housing for bringing the spring contact into contact with the printed wiring board and holding the printed wiring board in the housing.

In the illustrated embodiment, the heat seal film and the printed wiring board are substantially parallel to each other and spaced apart from each other in a vertical direction when they are contained in the housing.

Figure 3:
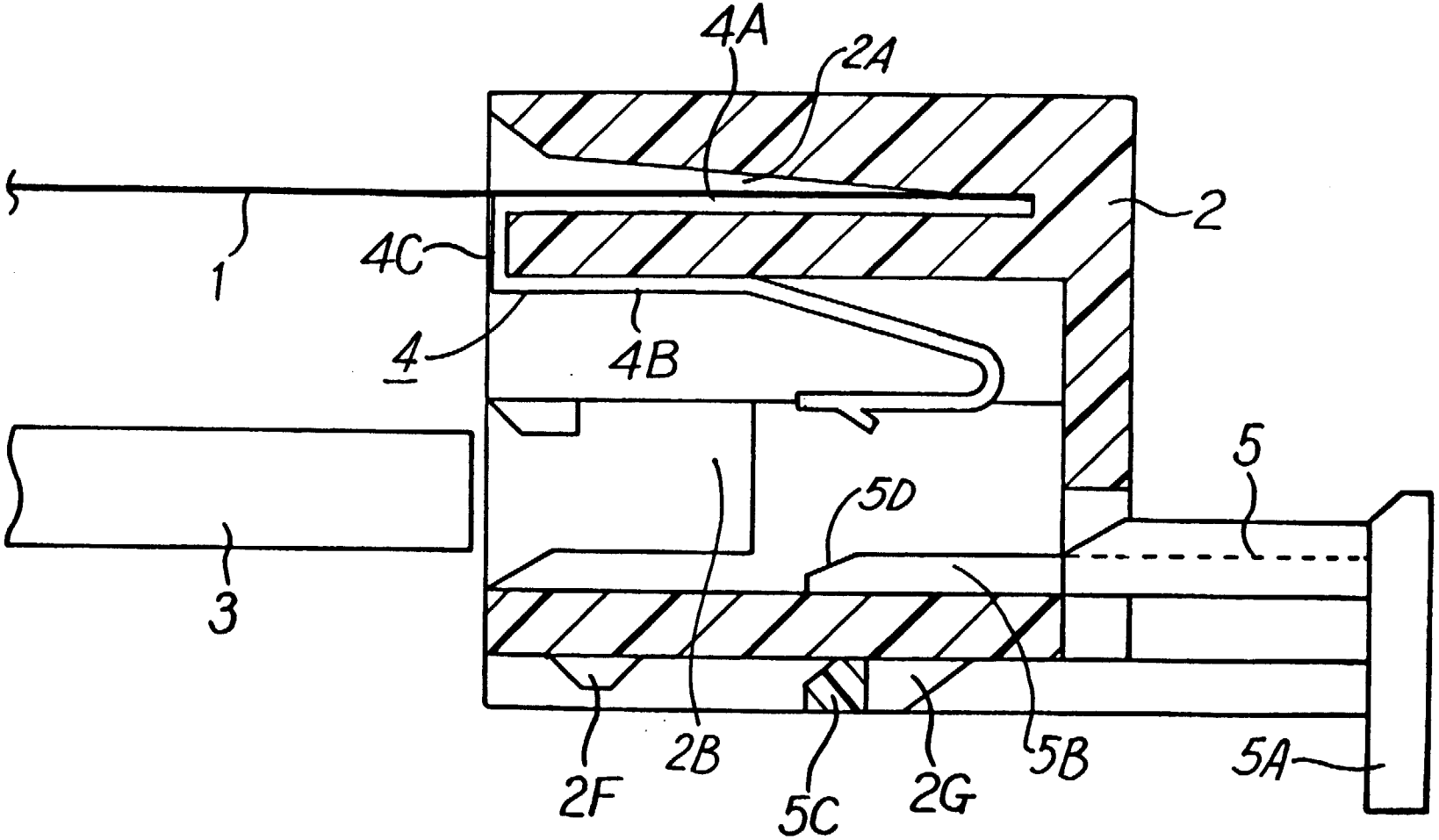
FIGS. 3 to 5 are longitudinal cross-sectional views showing the preferred embodiment as it is used.

The details of the spring contact 4 are shown in FIGS. 2 and 3, and there are a plurality of such spring contacts 4 in conformity with the number of the electrodes of the heat seal film. Each of the spring contacts 4 comprises a first contact portion 4A disposed in the first groove 2A of the housing, a second contact portion 4B disposed in said second groove 2B, and a connecting portion 4C connecting the first and second contact portions together. The first contact portion 4A, in the illustrated embodiment, is disposed in a contact containing slot 2E formed by partition walls 2D (see FIG. 2) provided in housing 2. The second contact portion 4B is formed into a reversely bent edge-like shape.

The actuator 5 specifically comprises an operating portion 5A, a plate-like acting portion 5B and a latch frame 5C. The plate-like acting portion 5B is inserted into the second containing groove 2B from a side opposite to the direction in which the printed wiring plate 3 is inserted.

The acting portion on the plate 5B is provided with a cam projection 5D cooperating with the spring contact to sandwich and hold the printed wiring board 3 contained in said second containing groove 2B. The latch frame 5C protrudes from the operating portion 5A in parallel to the acting portion 5B on at least one side of the actuator in the lengthwise direction thereof. The latch frame 5C comes into engagement with a latch projection 2F provided on the bottom of the housing when the actuator 5 is pushed into the housing, and strikes against a latch projection 2G provided on the bottom of the housing for stopping the actuator when the actuator is drawn out relative to the housing, thereby preventing the actuator from slipping out of the housing.

Figure 4:
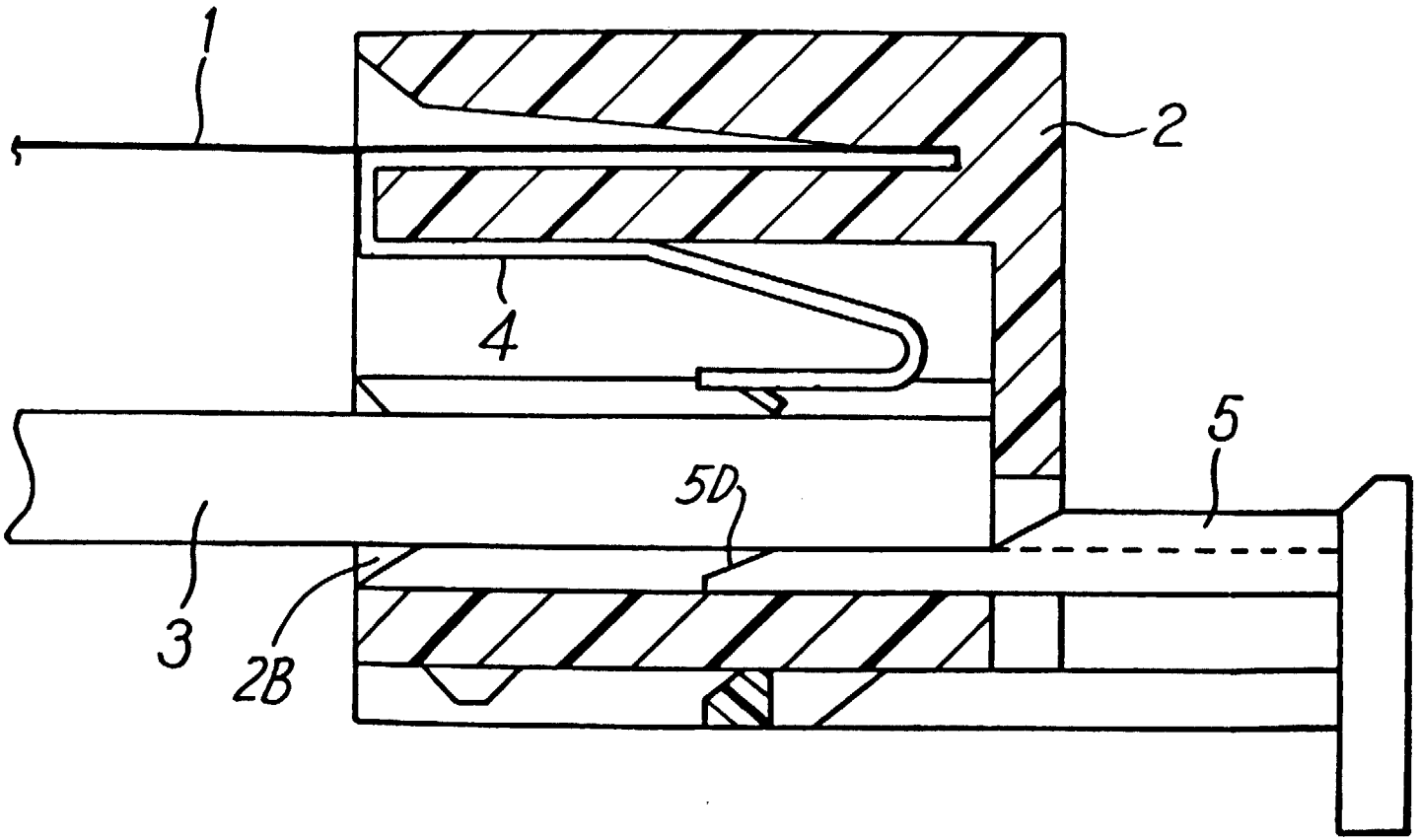
Figure 5:
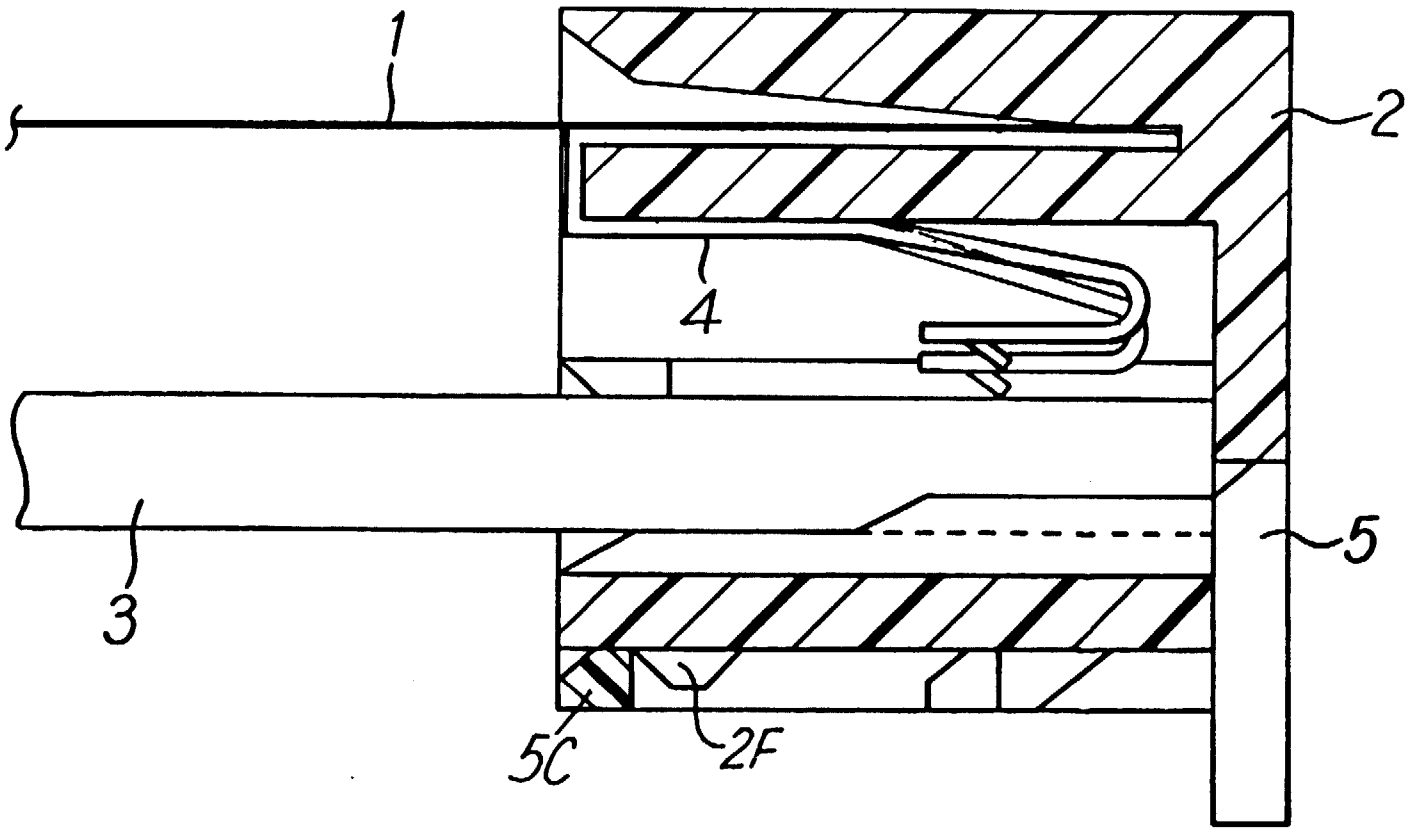

FIGS. 3 to 5 show a case where the heat seal film and the printed wiring board 3 are actually connected together by the use of the connector of the present device. First, as shown in FIG. 3, the heat seal film 1 is wedged into the first groove 2A and an electrical connection between the electrode of the heat seal film and the spring contact 4 is achieved. Then as shown in FIG. 4, the actuator 5 is drawn out relative to the housing 2, and the printed wiring board 3 is inserted into the second groove 2B in the housing. Subsequently, as shown in FIG. 5, the actuator 5 is pushed into the housing 2, whereupon the printed wiring board 3 is biased toward the spring contact 5 by the camming action 5D of the actuator 5. The electrode of the printed wiring board 3 is brought into contact with the spring contact 4 to thereby electrically connect them together. During connection the latch projection 2C (FIG. 2) of the housing fits into a latch groove 3B in the printed wiring board and the latch frame 5C of the actuator comes into engagement with the latch projection 2F of the housing, whereby the printed wiring board is held in the housing.

The connector of the present device need not be actually mounted (soldered) on the printed wiring board. Also, unlike prior-art connectors which are actually mounted on a board and thereafter on which a readily deformable heat seal film is mounted or dismounted, the connector of the present device assumes the so-called non-insertion force type structure in which the actuator is operated to thereby connect the printed wiring board to the connector. Therefore, the connection of the printed wiring board to the heat seal film can be readily accomplished without the heat seal film being damaged.

Having described the preferred embodiment of the invention herein, it should be appreciated that variations may be made thereto without departing from the contemplated scope of the invention. For example, instead of a heat seal film, other electrical devices, such as a flexible jumper, may be used. Accordingly, the preferred embodiment described herein is intended in an illustrative rather than a limiting sense. The true scope of the invention is set forth in the claims appended hereto.

I claim:

1. An electrical connector comprising:

a housing (2) including a front face and a rear wall, said housing having a first groove (2A) extending therein and opening through said housing front face, said first groove (2A) being defined by relatively inclined housing surfaces to have a wedge-shaped configuration with a wider portion thereof opening at said housing front face, said groove (2A) being adapted for receiving therein a flexible film (1) in a wedge-like manner, said housing having a second groove (2B) for receiving therein a substrate (3), said second groove (2B) opening through said housing front face, said film (1) and said substrate (3) being insertable in said housing from the same direction and mountable in said housing while being spaced apart in a vertical direction from each other and substantially parallel to each other;

a spring contact (4) supported by said housing for electrically connecting an electrically conductive electrode (1A) of the film received in said first groove and an electrically conductive electrode (3A) on said substrate received in said second groove; and an actuator (5) slidably supported in said housing through said rear wall for bringing said spring contact into contact with said electrode on said substrate and for holding said substrate in said housing.

2. A connector according to claim 1, characterized in that said substrate has a hole for latching, and said housing has a latch projection to be fitted in said hole.

3. A connector according to claim 1, characterized in that said spring contact is of a substantially U-shaped cross-section comprising a first contact portion disposed in said first groove, a second contact portion disposed in said second groove, and a connecting portion connecting said first and second contact portions together.

4. A connector according to claim 1, characterized in that said first and second grooves communicate with each other.

5. A connector according to claim 1, characterized in that opening portions of said first and second grooves are formed so as to be in the same surface of said housing.

6. A connector according to claim 1, characterized in that said actuator comprises an operating portion, a plate-like acting portion and a latch frame, and a bottom surface of said housing is interposed between said acting portion and said latch frame.

7. A connector according to claim 6, characterized in that said plate-like acting portion is provided with a cam projection cooperating with said spring contact to sandwich and hold the substrate received in said second groove.

8. An electrical connector comprising:

a housing (2) including a front face, a bottom surface, a top surface and a rear wall, said housing having a first groove (2A) extending therein between said housing top and bottom surfaces and opening through said housing front face, said groove (2A) adapted for receiving therein a flexible film (1), said housing having a second groove (2B) extending therein between said housing top and bottom surfaces and opening through said housing front face, said groove (2B) adapted for receiving therein a substrate (3);

a spring contact (4) supported by said housing for electrically connecting an electrically conductive electrode (1A) of the film received in said first groove and an electrically conductive electrode (3A) on substrate received in said second groove; and an actuator (5) slidably supported in said housing through said rear wall for bringing said spring contact into contact with said electrode on said substrate and holding said substrate in said housing, said actuator comprising an operating portion disposed exteriorly of said rear wall, a plate-like acting portion extending interiorly of said housing and a latch frame, said bottom surface of said housing being interposed between said acting portion and said latch frame.

9. A connector according to claim 8, characterized in that said plate-like acting portion is provided with a cam projection cooperating with said spring contact to sandwich and hold the substrate received in said second groove.

10. An electrical connector comprising:

a housing including a front face and a rear wall, said housing having a first groove (2A) opening at said front face for receiving therein a flexible film (1) and a second groove (2B) opening at said front face for receiving therein a substrate (3), said housing including a cantilevered wall supported by said rear wall and disposed between said first groove and said second groove;

a spring contact (4) supported on said cantilevered wall, said spring contact having a first portion (4A) lying along one surface of said cantilevered wall and disposed in said first groove, said first contact portion (4A) being adapted for electrically connecting an electrically conductive electrode (1A) of the film received in said first groove, a second portion (4B) lying along an opposite surface of said cantilevered wall and disposed in said second groove, said second contact portion (4B) being adapted for electrically connecting an electrically conductive electrode (3A) on said substrate received in said second groove, said first contact portion (4A) and said second contact portion (4B) being connected by a contact connection portion (4C); and an actuator (5) slidably supported in said housing through said rear wall for bringing said spring contact portion (4B) into contact with said electrode (3A) on said substrate and for holding said substrate in said housing second groove, said actuator comprising an operating portion, a plate-like acting portion and a latch frame, a bottom surface of said housing being interposed between said plate-like acting portion and said latch frame.

11. A connector according to claim 10, wherein said contact second portion (4B) comprises a resilient engagement portion projecting outwardly from said cantilevered wall.

12. A connector according to claim 11, wherein said resilient portion terminates in a reversely bent portion having a free end facing said housing front face.

13. A connector according to claim 12, wherein said contact portion (4C) extends around a free end of said cantilever wall, adjacent said housing front face.

14. A connector according to claim 13, wherein said first groove (2A) is defined by an inner surface of said housing and a surface of said cantilever wall to have a wedge-like configuration with a wider portion of said wedge-like groove opening at said housing front face.

* * * * *